United States Patent [19]

Carter et al.

[11] 4,386,815

[45] Jun. 7, 1983

[54] CONNECTOR ASSEMBLY FOR MOUNTING A MODULE ON A CIRCUIT BOARD OR THE LIKE

[75] Inventors: Clyde T. Carter, Shermans Dale; Reuben E. Ney, Mt. Joy, both of Pa.

[73] Assignee: AMP Incorporated, Harrisburg, Pa.

[21] Appl. No.: 252,509

[22] Filed: Apr. 8, 1981

[51] Int. Cl.[3] ..... H01R 9/09

[52] U.S. Cl. ..... 339/17 M; 29/830; 339/75 MP; 339/176 MP

[58] Field of Search ..... 339/17 L, 17 LC, 17 LM, 339/17 M, 176 MP, 75 MP; 29/830

[56] References Cited

U.S. PATENT DOCUMENTS

| | | | |
|---|---|---|---|
| 3,299,392 | 1/1967 | Evans | 339/17 L |
| 3,329,926 | 7/1967 | Aksu et al. | 339/17 L |
| 3,413,594 | 11/1968 | Fernald et al. | 339/176 |
| 3,474,387 | 10/1969 | Krum et al. | 339/75 MP |
| 3,651,444 | 3/1972 | Desso et al. | 339/42 |
| 3,801,953 | 4/1974 | Lynch | 339/176 MP |
| 3,864,000 | 2/1975 | Coller et al. | 339/17 LC |
| 3,912,353 | 10/1975 | Kasuya et al. | 339/176 MP |
| 3,966,290 | 6/1976 | Little et al. | 339/17 LC |
| 4,028,794 | 6/1977 | Ritchie et al. | 29/629 |
| 4,245,876 | 1/1981 | Ritchie et al. | 339/59 M |

*Primary Examiner*—John McQuade
*Attorney, Agent, or Firm*—Russell J. Egan

[57] ABSTRACT

A connector assembly is disclosed for mounting a module on a circuit board or the like without requiring any soldering. The subject assembly includes a header mounted on a circuit board to at least partially enclose an area of contacts integral with the circuit board. A plug assembly is secured to a mating module and adopted to engage in the header. The plug assembly includes an outer housing enclosing an inner housing which is directly attached to the module and movable within the outer housing. At least one series of spring terminals are mounted in the plug assembly with a first portion engaging the outer housing and a second portion bearing against the module carried by the inner housing. Spring bias means are mounted in the outer housing bearing against the opposite side of the inner housing from the terminals. Both the terminal and the bias spring are profiled to assume either a rest condition, or an over centered contacting position so that when the plug assembly is mated into the header there is initially no contact force but subsequently insertion force applied over centers the terminals and the bias spring to place them into an over centered condition in which the terminals engage both the module and the circuit board making good electrical and mechanical contact therebetween. It is particularly of note that no solder is required in the subject invention and that all electrical contacts are made through a mechanical action.

13 Claims, 9 Drawing Figures

CONNECTOR ASSEMBLY FOR MOUNTING A MODULE ON A CIRCUIT BOARD OR THE LIKE

BACKGROUND OF THE INVENTION

1. The Field of the Invention

The present invention relates to an assembly for interconnecting a module with a circuit board, for example, a mother/daughter board interconnect, and in particular to a system which obviates the need for anything other than a simple mechanical interconnect.

2. The Prior Art

There are many known schemes for connectors to assemble a first circuit board with a second circuit board, commonly known as a mother/daughter board interconnect. The systems generally require a header on the mother board and a plug on the daughter board with at least one of the header and plugs being soldered to the respective board. Examples of such connector systems can be found in U.S. Pat. Nos. 3,413,594; 3,651,444; and 3,966,290. These known systems have disadvantages, one being the cost of running the connector through a soldering operation. The need for such a soldering operation necessarily increases the manufacturing cost plus adds the possibility of damage to the connector system either by the solder itself or by the heat of the soldering operation.

SUMMARY OF THE INVENTION

It is the intention of the present invention to produce a connector assembly for mating a module with a circuit board or the like which assembly requires no soldering operation on either the module or circuit board and yet will provide a good mechanical and electrical interconnection therebetween. The subject connector assembly has a header which is mechanically mounted on a circuit board to at least partially enclose a contact area. The subject connector assembly also has a plug assembly which is mechanically mounted on a mating module. The plug assembly has an outer housing defining a cavity with an inner housing slidably received therein and secured to the mating module.

A plurality of spring terminals are mounted between the outer and inner housings to engage the module in a first at rest condition and in a second over centered condition to engage both the module and the circuit board. A bias spring means is also mounted between the inner and outer housings to ensure the proper alignment thereof.

It is therefore an object of the present invention to produce an improved connector system for interconnecting a module with a circuit board or the like.

It is another object of the present invention to produce an improved mother/daughter board interconnect system.

It is a further object of the present invention to produce a connector assembly which obviates the need for soldering any of the components thereof to make an interconnection between a circuit board and a mating module.

It is another object of the present invention to produce an improved connector system in which a plurality of spring terminals are aligned in an at rest condition in an unmated condition and assume an over centered position in a mounted condition applying sufficient contact forces to two adjacent members to make good electrical and mechanical interconnect therebetween.

It is a further object of the present invention to produce a connector system which can be mated in an initial, non-contacting condition requiring low insertion forces and upon application of a further and higher insertion force, applied in the mated condition, will provide a tactile and audio indication of full contact mating.

It is another object of the present invention to produce an improved electrical connector assembly which can be readily and economically manufactured.

The means for accomplishing the foregoing objects and other advantages of the present invention will become apparent to those skilled in the art from the following detailed description taken with reference to the accompanying drawings.

DETAILED DESCRIPTION OF THE PREFERRED EMBODIMENT

Figure 1:
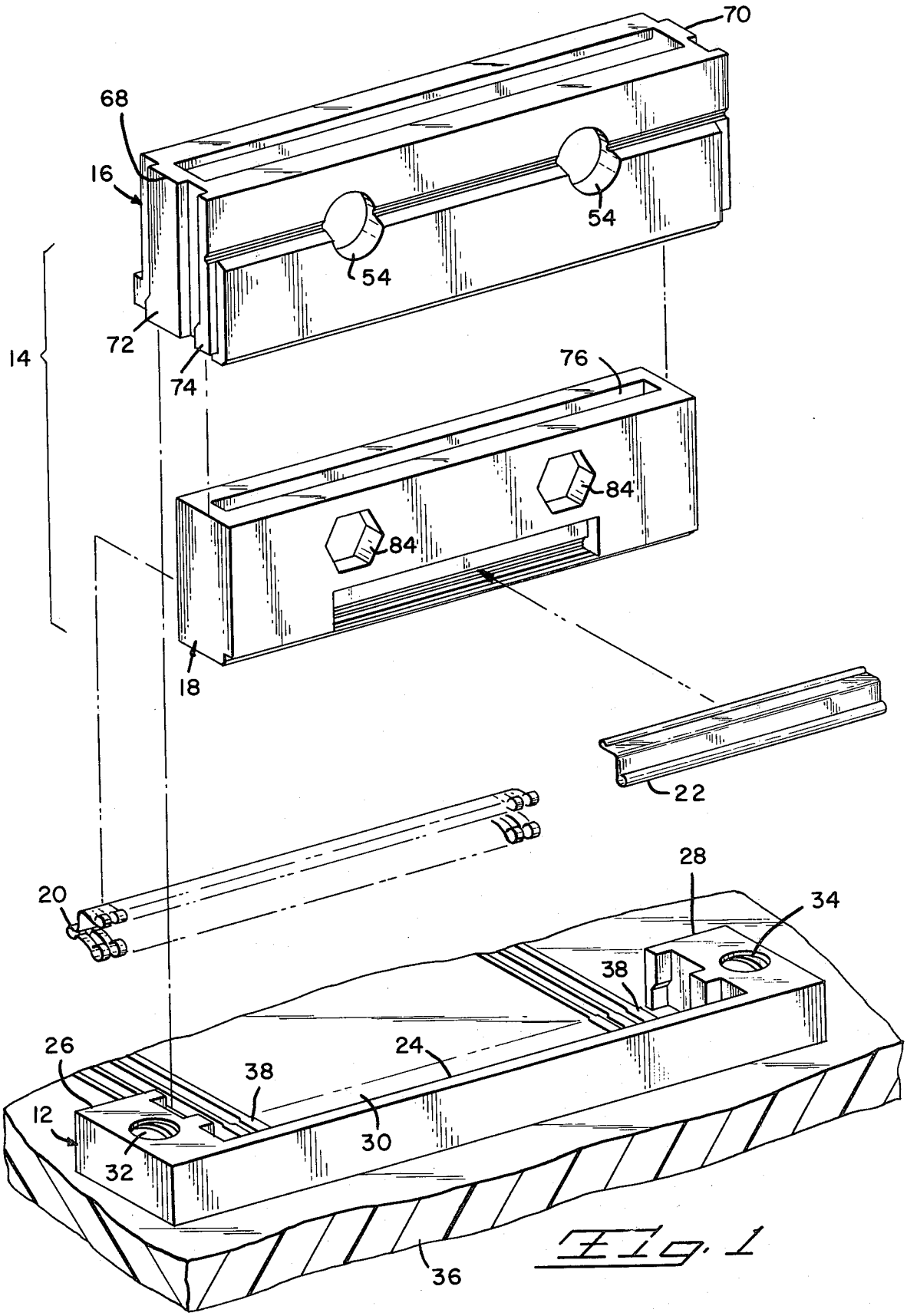
FIG. 1 is an exploded perspective view of the subject connector assembly.
Figure 2:
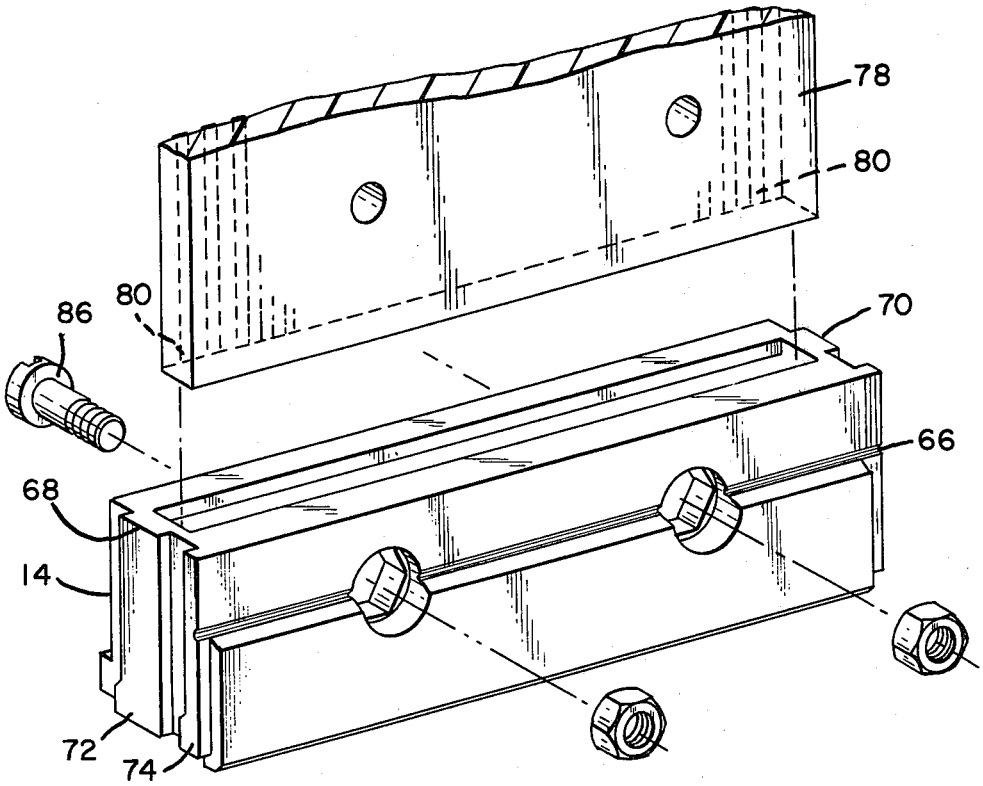
FIG. 2 is a perspective view of the plug portion of the present connector with a circuit board exploded therefrom.
Figure 3:
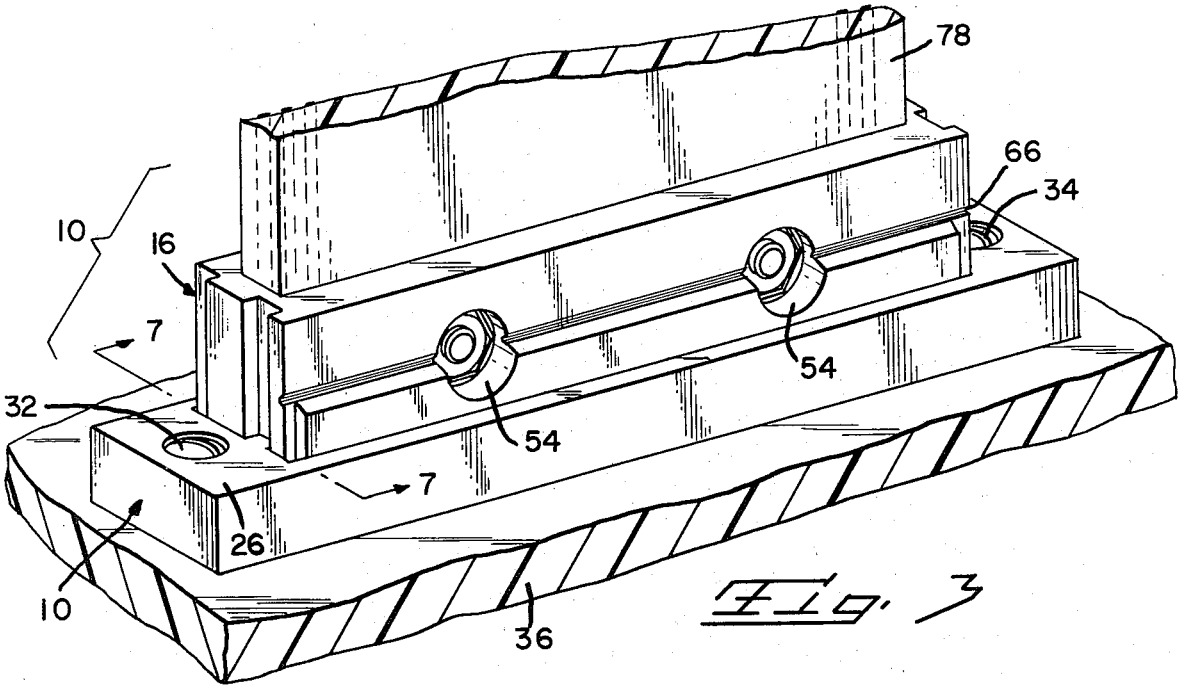
FIG. 3 is a perspective view of the subject connector in a fully assembled and mated condition.

The subject connector 10 includes a header 12, and a plug assembly 14 formed by an outer housing 16 and inner housing 18, a spring terminal array 20, and a bias spring member 22.

The header 12 is an elongated member of rigid insulative material having at least one sidewall 24 and a pair of spaced end flanges 26, 28 defining a central cavity 30. The end flanges each include means 32, 34 for mounting the header on circuit board 36 with the cavity 30 at least partially enclosing a plurality of contact pads 38 on the circuit board 36 (see FIG. 4). The inner surfaces of the spaced end flanges each have a pair of profiled recesses 40, 42 (see FIGS. 4 and 6). The sidewall 24 can be provided with a strengthening flange 44 (see FIGS. 4 and 6).

The plug assembly 14 has an outer housing 16 which defines a cavity 46 extending from a mating face 48 to a rear surface 50. The outer housing 16 also includes at least one aligned pair of access apertures 52, 54 in spaced side walls 56, 58. The wall 56 has a strap portion 60 forming an inwardly directed terminal receiving slot 62. The wall 58 has an inwardly directed spring receiving groove 64 and an outwardly directed flexure groove 66. The end walls 68, 70 each have outwardly directed profiles 72, 74 aligned to be received in the recesses 40, 42, respectively of the header 12. The inner housing 18 is profiled to be received in the cavity 46 and has a central elongated slot 76 for receiving therein an edge portion of a circuit board 78 having contact pads 80 thereon. The inner housing 18 also includes at least one pair of spaced aligned profiled apertures 82, 84 which receive mounting means 86 to secure the circuit board 78 to the inner housing 18. The apertures 82, 84 are spaced to be positioned in alignment with apertures 52, 54 of the outer housing 16 to allow insertion of mounting means 86. The leading end 88 of the inner housing 18 is profiled to have a slot 90 opening above the pad 80 and have an oppositely directed groove 92 spaced from the leading end 88.

The spring terminal array 20 is preferably formed in accordance with the disclosures of U.S. Pat. Nos. 4,028,794 and 4,245,876, the disclosures of which are incorporated herein by reference. The terminal array 20 has a plurality of individual spring terminals 94 held in spaced alignment by at least one continuous web of insulative material 96 secured to each terminal. Each terminal 94 has a first curled end 98 adopted to be received in the slot 90 engaging pad 80 of circuit board 78 and a second curled end 100 adapted to make engagement with a pad 38 of circuit board 36. The intermediate portion 102 of each terminal 94 is profiled to be received in slot 62.

The back-up or bias spring 22 is a continuous elongated member of spring material having a first curled end 104 profiled to be received in the groove 64 of outer housing 16. The opposite curled end 106 of the spring 22 is profiled to be received in the groove 92 of inner housing 18. The spring 22 also has a formed intermediate portion 108.

The subject connector is assembled by first mounting the header 12 on the circuit board 36 with mounting means 34, 36 in a known fashion. As previously stated the central cavity 30 of the header will enclose pads 38 formed on the circuit board 36. As a point of reference, it should be noted that circuit board 36 is frequently referred to as the mother board.

The plug assembly 14 is attached to the circuit board 78, which is commonly known as the daughter board. The inner housing 18 is inserted to the cavity 46 of the outer housing 16 and the terminal array 20 inserted in one side of the assembly between the two housings. The back-up spring 22 is inserted into the other side of the assembly of housings. It will be seen that the engagement of the respective ends 98 and intermediate portions 102 of the terminal array 20 and ends 104, 106 of the back-up spring 22 into the grooves 90, 62 and recesses 64, 92 of the housing members 16, 18 will hold them in an assembled condition. The daughter board 78 is inserted into the slot 76 of the inner housing 18 and the fastening means 86 are applied through the respective apertures 52, 82, 84, 54 to secure the board 78 to the inner housing 18. The assembly will now be in the condition as shown in FIG. 4.

Figure 4:
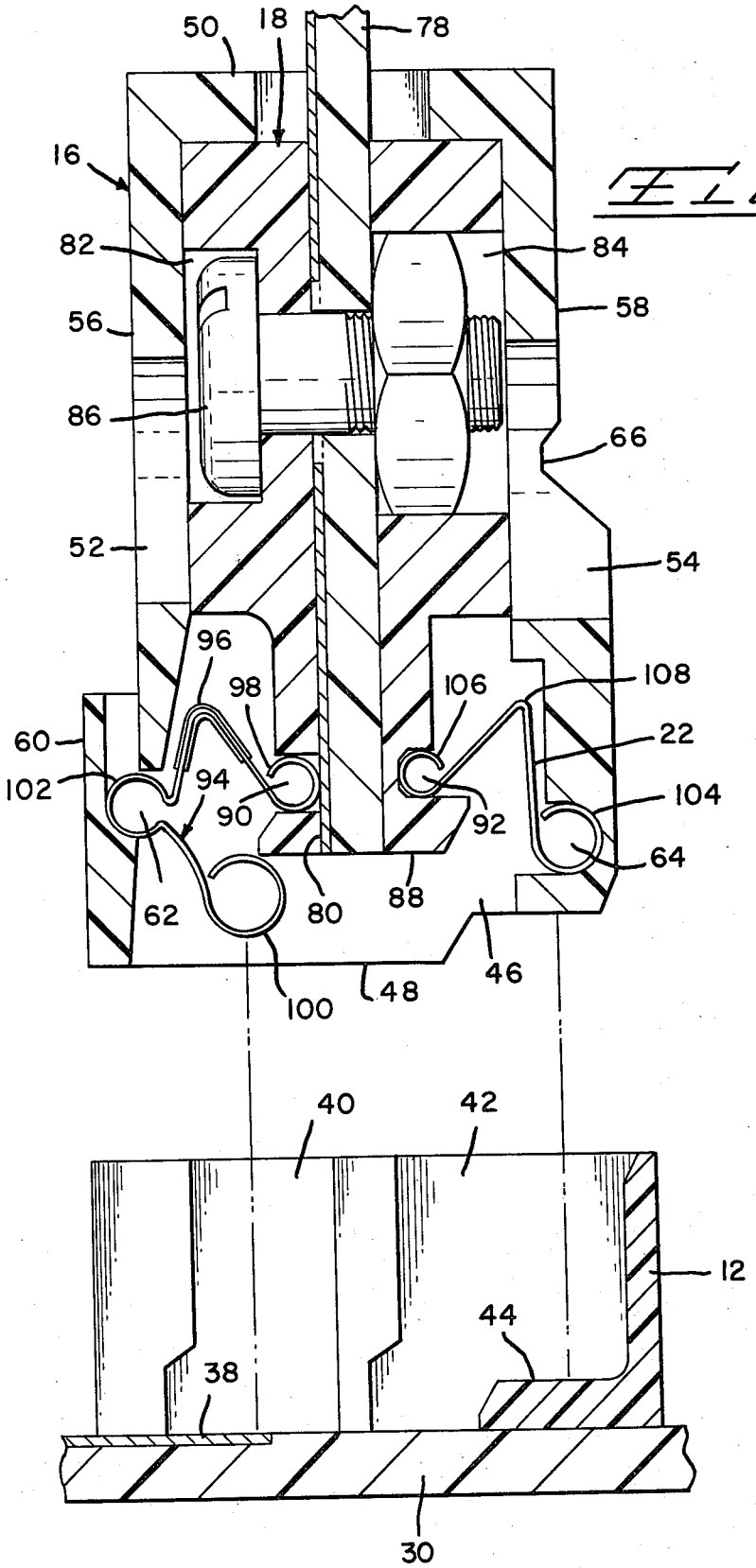
FIG. 4 is a transverse vertical section through the connector of the present invention in an unmated condition.
Figure 5:
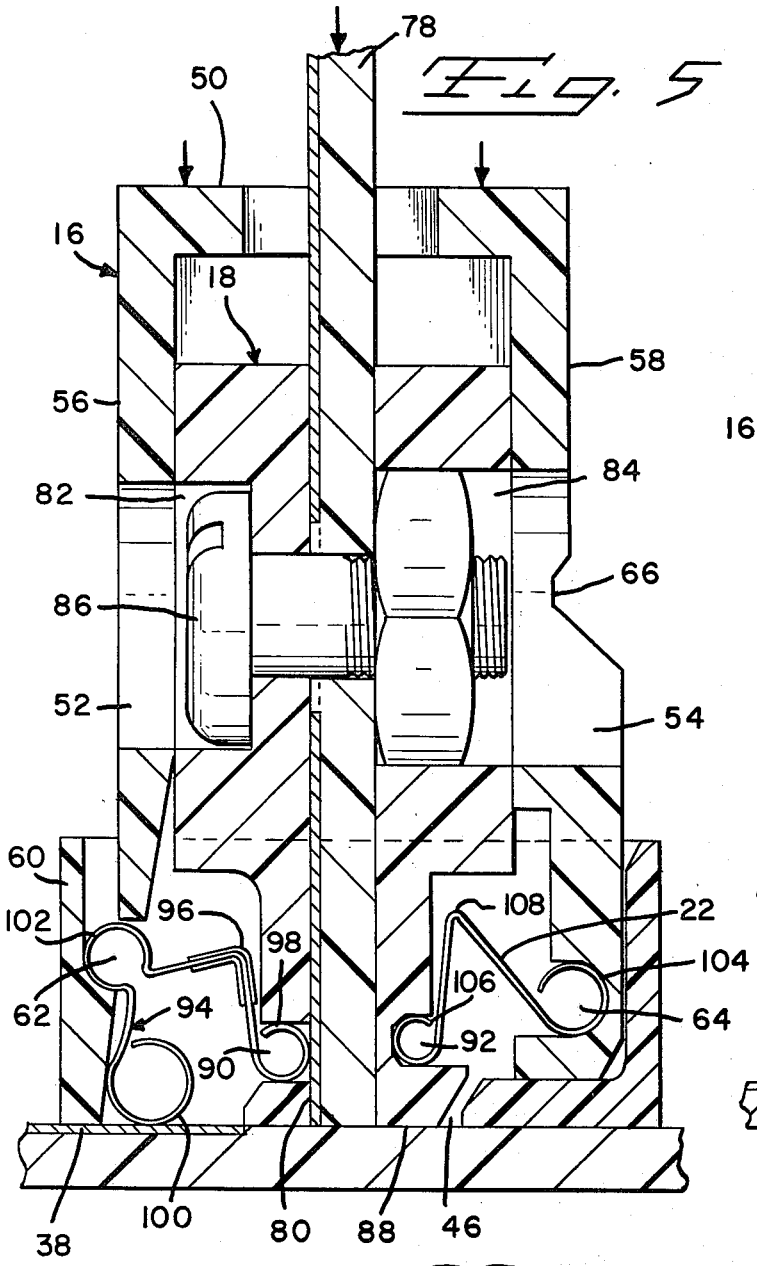
FIG. 5 is a section similar to FIG. 4 showing the subject connector in an engaged and contacting condition.

Mating of the subject connector is accomplished by first applying the plug assembly 14 to the header 12 as shown in FIGS. 4 and 5. During this movement there will be relatively little inital insertion force required as only a sliding interfit of the outer housing 16 with the header 12 will be noted. Continued insertion force applied to the circuit board 78 will drive the leading end 88 of the inner housing 18 against the circuit board 36 with the relative movement between the inner and outer housings causing over-centering of the contact array 20 and the back-up spring 22 as shown. The intermediate portions 102 of the terminals 94 and portion 108 of the back-up spring 22 are formed to allow this over-centering action while strip 60 and groove 66 provide the necessary flexure in the outer housing 16 to accomplish this action.

Figure 6:
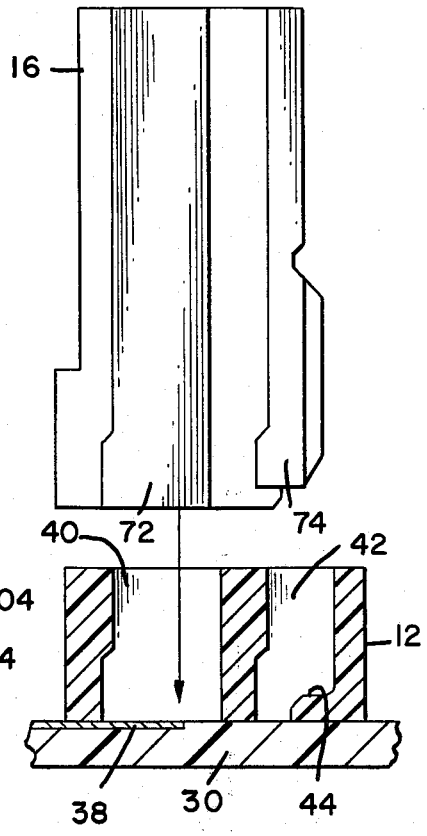
FIG. 6 is a detail view, partially in section, taken along line 7—7 of FIG. 3 showing the subject connector in an unmated condition.
Figure 7:
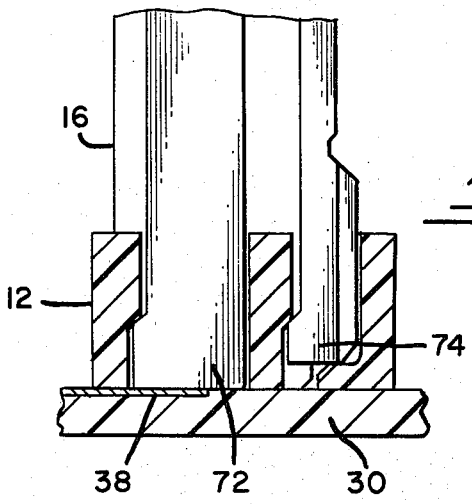
FIG. 7 is a detail view similar to FIG. 6 taken along line 7—7 of FIG. 3 and showing an end portion of the subject connector in a mated condition.

It will be noted from FIGS. 6 and 7 that as the outer housing member 16 is inserted fully into the header 12 that the profiled ends 72, 74 of the housing 16 engage in the recesses 40, 42 of the header 12 to lock the plug assembly 14 and header 12 together. This ultimate mating will cause an audible and tactile indication of full mating of the connector 10.

Figure 9:
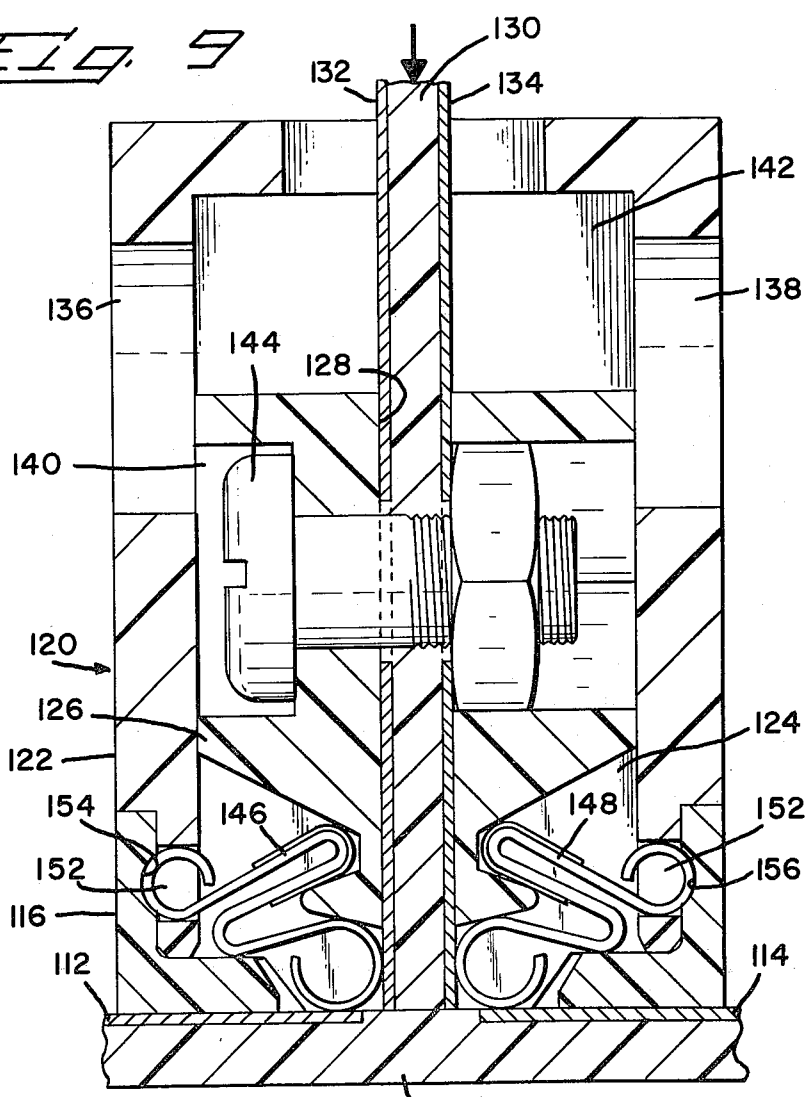
FIG. 9 is a transverse vertical section through the alternate embodiment of FIG. 8 in an engaged and contacting condition.
Figure 8:
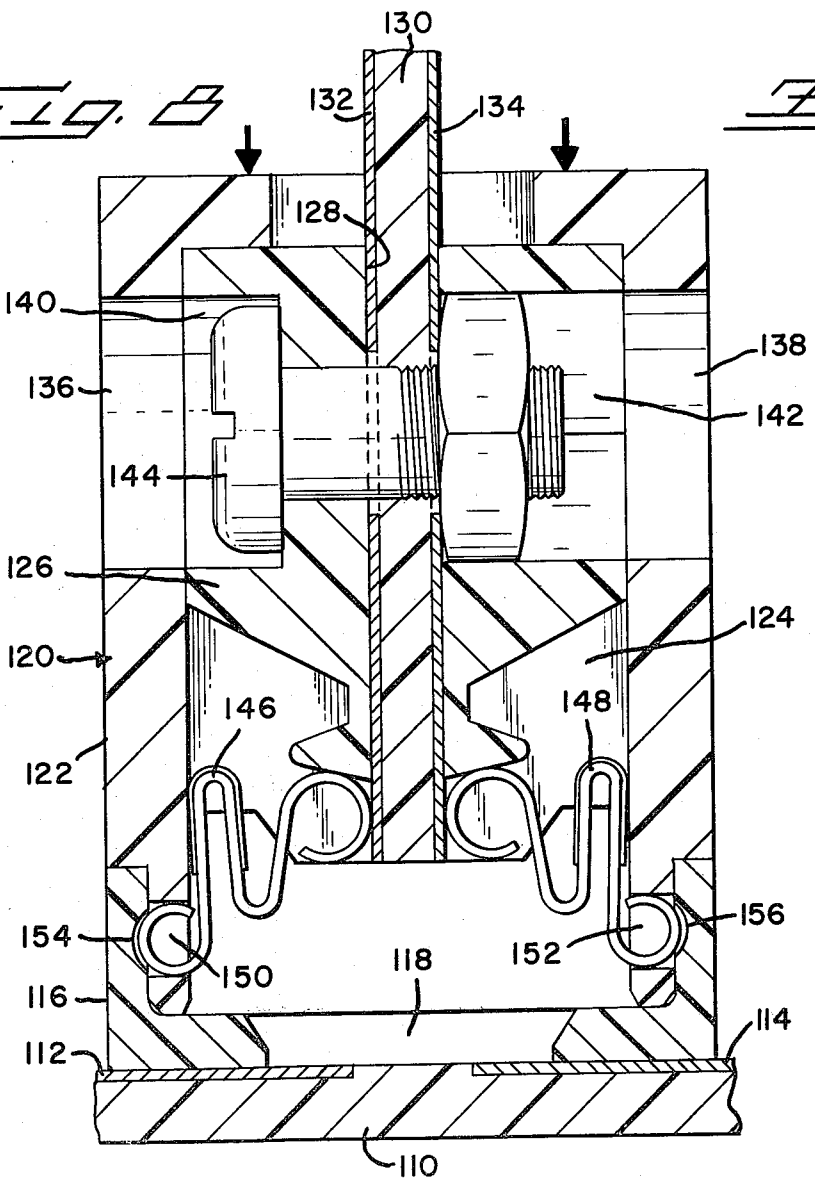
FIG. 8 is a transverse vertical section through an alternate embodiment of the subject invention in a mated but non-contacting condition.

FIGS. 8 and 9 show an alternate embodiment of the subject invention which is designed for use with two-sided daughter boards. In this case the mother circuit board 110 has first and second pads 112, 114 enclosed by header 116 defining a cavity 118 over the pads. The header 116 is secured to the circuit board 110 by conventional means (not shown). The plug assembly 120 has an outer housing 122 profiled to be received within cavity 118. The outer housing 122 defines a cavity 124 which slidably receives inner housing 126 therein. The inner housing 126 has an elongated slot 128 which receives daughter circuit board 130 therein. The daughter circuit board 130 has first and second circuitry 132, 134 on the opposite side thereof. The outer housing 122 and inner housing 126 are provided with at least one set of apertures 136, 138, 140, 142, aligned to receive fastening means 144 to secure the daughter board 130 to the inner housing 126. First and second spring terminal arrays 146, 148 are mounted between slots 150, 152 of the outer housing 122 and respective circuits 132, 134 of the daughter circuit board 130. These terminal arrays are formed in the manner of terminal array 20.

The assembly of this embodiment is substantially the same as with the first embodiment and therefore need not be repeated. The operation is also substantially the same. The plug assembly 120 is inserted into the header 116, as shown in FIG. 8, with little insertion force being required and no interconnection being effected. The daughter circuit board 130 and inner housing 126 are then driven into abutment with mother circuit board 110, as shown in FIG. 9. This additional movement causes over-centering of terminal arrays 146, 148 bringing them into the interconnect position of FIG. 9 engaging both the pads of the mother circuit board and the daughter circuit board. It should also be noted, from FIG. 9, that the terminal arrays 146, 148 can project from slots 150, 152 to engage in recesses 154, 156 to hold and lock the plug assembly 120 into the header 116. This will also give the previously discussed audible and tactile indication of full mating.

The present invention may be subject to many modifications and changes without departing from the spirit or essential characteristics thereof. The present embodiments are therefore to be considered in all respects as illustrative and not restrictive of the scope of the invention.

What is claimed is:

1. An electrical connector system for effecting mother/daughter circuit board interconnections comprising:

a header member mounted on a mother circuit board, said header member having a central cavity at least partially enclosing a plurality of contact pads on said mother circuit board; and a plug assembly mounted on said daughter circuit board, said plug assembly comprising an outer housing defining a cavity, an inner housing slidably received in said cavity, means for attaching said daughter circuit board to said inner housing, a spring terminal array mounted between said outer housing and said daughter circuit board, and at least one back-up spring member mounted between said inner and outer housings in opposition to said spring terminal array, whereby relative movement of said inner housing with respect to said outer housing after initial engagement of said plug assembly into said header causes said terminal array to engage with said mother circuit board to interconnect said mother and said daughter circuit boards.

2. An electrical connector system according to claim 1 wherein said array of spring terminals comprises:

a web of insulative material, and a plurality of terminals mounted on said web in fixed, spaced fashion, each said terminal having a mounting portion adapted to engage in said outer housing and first and second contacting portions adapted to engage the contact pads of said mother and said daughter circuit boards respectively.

3. An electrical connector system according to claim 2 wherein said mounting portion of each said terminal lies intermediate the ends thereof and said first and said second contacting portions are at said opposite ends.

4. An electrical connector system according to claim 1 further comprising:

latching means on said outer housing and corresponding latching means on said header member, said latching means engaging upon mating of said plug assembly into said header member to hold them in the mated condition.

5. An electrical connector system according to claim 1 wherein relative movement of said inner housing with respect to said outer housing causes said spring terminal array to move from a first position contacting only the pads of said daughter circuit board to a second position contacting the pads of both said mother and said daughter circuit boards.

6. An electrical connector system according to claim 1 wherein said back-up spring member comprises:

a second array of spring terminals mounted between the opposite side of said daughter circuit board and an adjacent portion of said outer housing, whereby double sided daughter circuit boards can be interconnected with a mother circuit board.

7. An electrical connector system according to claim 1 wherein said inner and said outer housings have limited flexibility to accommodate the necessary movement of said terminal array to effect interconnection.

8. A connector system for interconnecting a circuit module with a circuit board, said system comprising:

a header having means for mounting on said circuit board to at least partially enclose a plurality of contact pads thereon;

a plug assembly adapted to be mounted on said module and having an inner housing secured to an edge portion of said module, an outer housing defining a cavity receiving said inner housing therein in relative sliding relationship, a plurality of spring terminals extending between said outer housing and a like plurality of contact pads on said module carried by said inner housing, and at least one back-up spring means extending between said inner and outer housings in opposition to said spring terminals, whereby said outer housing is received in said header and sliding movement of said inner housing with respect to said outer housing causes said spring terminals to engage both said module contact pads and said circuit board contact pads.

9. A connector system according to claim 8 further comprising:

latching means on said header and said outer housing, whereby said plug assembly is secured in said header after mating.

10. A connector system according to claim 8 wherein said spring terminals are elongated conductive spring members secured in fixed spaced relationship to a web of insulative material, whereby said terminals can be handled as a unit.

11. A connector system according to claim 8 wherein each said terminal has a folded intermediate portion engaging in said outer housing and profiled end portions adapted to engage said module and said circuit board respectively.

12. A connector system according to claim 8 wherein said back-up spring means comprises:

a second plurality of spring terminals extending between said outer housing and an opposite portion of said module from said spring terminals, whereby double sided interconnection can be effected.

13. A method of interconnecting a mother circuit board with a daughter circuit board comprising the steps of:

mounting a header member on the mother circuit board, said header member at least partially enclosing a plurality of contact pads on said mother circuit board;

mounting a plug assembly on said daughter circuit board, said plug assembly including an inner housing member directly connected to the daughter circuit board and an outer housing member having a cavity receiving the inner housing member and a portion of said daughter circuit board therein in sliding relationship, a plurality of spring terminals in said plug assembly extending between said outer housing and said daughter circuit board and back-up spring means extending between said inner housing and said outer housing in opposition to said spring terminals;

and mating said plug assembly into said header so as to effect relative sliding motion between said inner and outer housings to move said contact springs from an at rest condition to an over centered condition in which they are sufficiently exposed from said plug assembly to engage said contact pads on said mother circuit board.

* * * * *